US008393190B2

(12) United States Patent
Taniguchi

(10) Patent No.: US 8,393,190 B2
(45) Date of Patent: Mar. 12, 2013

(54) TUBE FORMING APPARATUS AND TUBE FORMING METHOD

(75) Inventor: Hideshi Taniguchi, Osaka (JP)

(73) Assignee: Fuji Machine Works Co., Ltd., Osaka (JP)

( * ) Notice: Subject to any disclaimer, the term of this patent is extended or adjusted under 35 U.S.C. 154(b) by 75 days.

(21) Appl. No.: 13/055,200

(22) PCT Filed: Jul. 28, 2009

(86) PCT No.: PCT/JP2009/063378

§ 371 (c)(1),
(2), (4) Date: Jan. 21, 2011

(87) PCT Pub. No.: WO2010/013688

PCT Pub. Date: Feb. 4, 2010

(65) Prior Publication Data

US 2011/0126967 A1 Jun. 2, 2011

(30) Foreign Application Priority Data

Jul. 29, 2008 (JP) ..... 2008-194327

(51) Int. Cl.
*B21D 39/02* (2006.01)
*B21C 37/06* (2006.01)

(52) U.S. Cl. ..... 72/51; 72/134; 72/170

(58) Field of Classification Search ..... 72/51, 52, 72/367.1, 134, 169–171, 368, 133, 389.1; 228/17, 151, 17.5, 17.7, 150
See application file for complete search history.

(56) References Cited

U.S. PATENT DOCUMENTS 3,879,994 A * 4/1975 Hume ..... 72/169
4,491,004 A * 1/1985 Ivanoff ..... 72/169
5,115,658 A * 5/1992 Kirchhoff et al. ..... 72/169
(Continued)

FOREIGN PATENT DOCUMENTS

JP 52-016987 2/1977
JP 52-016987 B 5/1977
(Continued)

OTHER PUBLICATIONS

Supplemental European Search Report for corresponding European Application No. 09802931.7 dated Dec. 22, 2011.

(Continued)

*Primary Examiner* — Edward Tolan
*Assistant Examiner* — Pradeep C Battula
(74) *Attorney, Agent, or Firm* — Renner, Otto, Boisselle & Sklar, LLP

(57) ABSTRACT

A tube forming apparatus performs a forwardly rotating step in which a main roll is rotated forwardly with a pair of subsidiary rolls in a forming position during a move of a contact position between the main roll and a work from a first end of the work to a central portion of the work, a feeding step in which the main roll is rotated forwardly with the pair of subsidiary rolls in a retracted position during a move of the contact position between the main roll and the work from the central portion of the work to a second end of the work, and a reversely rotating step in which the main roll is rotated reversely during a move of the contact position between the main roll and the work from the second end of the work to the central portion of the work.

2 Claims, 5 Drawing Sheets

U.S. PATENT DOCUMENTS

| | | | | |
|---|---|---|---|---|
| 6,044,675 | A * | 4/2000 | Davi | 72/173 |
| 6,725,699 | B1 | 4/2004 | Muller | |
| 8,061,172 | B2 * | 11/2011 | Gravier | 72/171 |

FOREIGN PATENT DOCUMENTS

| | | | |
|---|---|---|---|
| JP | 61-502175 | | 10/1986 |
| JP | 03-004283 | | 1/1991 |
| JP | 03-004283 | B | 1/1991 |
| JP | 03-033414 | | 2/1991 |
| JP | 2004-034038 | | 2/2004 |
| JP | 2004-130354 | | 4/2004 |
| WO | 85/05297 | | 12/1985 |
| WO | 00/53353 | A1 | 9/2000 |

OTHER PUBLICATIONS

Initial International Search Report for corresponding International Application No. PCT/JP2009/063378 mailed Sep. 15, 2009.

* cited by examiner

W
W1
W2
W3
2
3
31

TUBE FORMING APPARATUS AND TUBE FORMING METHOD

TECHNICAL FIELD

The present invention relates to tube forming apparatus and method for forming a work of a plastic sheet-shaped material into a tubular shape by bending and, more particularly, to tube forming apparatus and method for forming such a work into a tube having a continuous length and a small diameter.

BACKGROUND ART

A tube forming apparatus having a plurality of rotatable rolls is used to form a work of a plastic sheet-shaped material, such as sheet metal, into a tubular shape.

One known tube forming apparatus, as a first tube forming apparatus, includes a rotatably supported single main roll and a plurality of rotatably supported subsidiary rolls (see Patent Document 1 for example). This apparatus is designed to pass a work between the main roll and each of the subsidiary rolls sequentially to bend the work toward the main roll side, thereby forming the work into a tubular shape.

Another known tube forming apparatus, as a second tube forming apparatus, includes a hard main roll and an elastic roll which are designed to rotate by being pressed against each other (see Patent Document 2 for example). This apparatus is designed to pass a work through the nip defined between the two rolls to wrap the work around the peripheral surface of the hard roll, thereby forming the work into a tubular shape.

RELATED ART DOCUMENT

Patent Document

Patent Document 1: Japanese Patent Laid-Open Publication No. 2004-034038

Patent Document 2: Japanese Patent Laid-Open Publication No. 2004-130354

DISCLOSURE OF THE INVENTION

Problems to be Solved by the Invention

With the first tube forming apparatus, however, the work is bent along the peripheral surface of the main roll and, hence, the main roll in a state of being supported only at its opposite ends is subjected to the pressing force from each of the subsidiary rolls across the work over the entire length thereof. For this reason, when a roll having a long axial length is used as the main roll in order to form a tube having a continuous length, the main roll becomes deflected in such a direction that an axially intermediate portion thereof moves away from each subsidiary roll.

With the second tube forming apparatus, similarly, the work is wrapped around the peripheral surface of the main roll and, hence, the main roll in a state of being supported only at its opposite ends is subjected to the pressing force from the elastic roll across the work over the entire length thereof. For this reason, when a roll having a long axial length is used as the main roll in order to form a tube having a continuous length, the main roll becomes deflected in such a direction that an axially intermediate portion thereof moves away from the elastic roll.

In forming a tube having a small diameter, in particular, the main roll needs to have a small diameter also and hence becomes more deflectable at its axially intermediate portion because of its lowered rigidity.

As the main roll becomes deflected, the diameter of the work varies in accordance with amounts of deflection, which makes it impossible to form the work into a tube having a continuous length and a small diameter that is made uniform over the entire length.

An object of the present invention is to provide tube forming apparatus and method which are capable of inhibiting displacement of the main roll in the direction away from the subsidiary roll at plural points in the axial direction of the main roll thereby making it possible to form a work into a tubular shape having a continuous length and a small diameter that is made uniform over the entire length.

Means for Solving the Problems

In order to solve the foregoing problem, a tube forming apparatus according to the present invention includes a main roll, a pressing member, first and second driving sources, a moving mechanism, and a control section. The main roll is rotatably supported on a frame and has a smaller radius than a predetermined radius of a tubular shape to be formed from a work. The pressing member is disposed such that a surface thereof and a peripheral surface of the main roll are capable of nipping the work therebetween while being supported on the frame to allow the surface thereof to move in a direction perpendicular to an axial direction of the main roll. The first driving source is configured to selectively transmit forward rotation and backward rotation to the main roll. The second driving source is configured to supply the pressing member with a moving force for selectively moving the surface of the pressing member forwardly and backwardly. The moving mechanism is configured to change a relative position between the peripheral surface of the main roll and the surface of the pressing member to a forming position in which the peripheral surface of the main roll and the surface of the pressing member are close to each other to such an extent that the radius of curvature of the work nipped therebetween becomes smaller than the predetermined radius or to a retracted position in which the peripheral surface of the main roll and the surface of the pressing member define therebetween a spacing that is larger than the thickness of the work, selectively.

The control section is configured to control the first and second driving sources and the moving mechanism. During bending, the control section sequentially performs a forwardly rotating step of forwardly rotating the main roll during a move of a contact position between the peripheral surface of the main roll in the forming position and the work from a first end of the work to a central portion of the work, a feeding step of forwardly rotating the main roll during a move of a contact position between the peripheral surface of the main roll in the retracted position and the work from the central position of the work to a second end of the work, and a reversely rotating step of reversely rotating the main roll during a move of the contact position between the peripheral surface of the main roll in the forming position and the work from the second end of the work to the central portion of the work, while moving the surface of the pressing member to feed the work in a desired direction cooperatively with the peripheral surface of the main roll in each of the steps.

With this construction, the forwardly rotating step bends the portion of the work extending from the first end to the central portion into an arcuate shape having a smaller radius of curvature than the predetermined radius by passing that portion of the work between the main roll and the pressing member. The reversely rotating step bends the portion of the work extending from the central portion to the second end into an arcuate shape having a smaller radius of curvature than the predetermined radius by passing that portion of the work between the main roll and the pressing member.

As the work passes between the main roll and the pressing member, a deformation toward restoration, called "spring back", occurs due to the counterforce produced by bending, resulting in a bend having an increased radius of curvature. Since the main roll has a smaller radius than the predetermined radius of the tubular shape to be formed from the work, the radius of curvature determined from the position of a contact point between the main roll and the work and the position of a contact point between the pressing member and the work is also smaller than the predetermined radius. For this reason, by using a roll having an appropriately adjusted radius as the main roll, the work having been subjected to the reversely rotating step takes on a tubular shape entirely having the predetermined radius.

The work is subjected to separate two bending steps one of which is the forwardly rotating step in which the portion of the work extending from the first end to the central portion is fed in one direction, the other of which is the reversely rotating step in which the portion of the work extending from the central portion to the second end is fed in the opposite direction. The ends of the work are displaced in directions away from the center of the radius of curvature of the resulting bend by the spring back described above. Therefore, each end of the work fails to go beyond a 180° angle range in the circumferential direction of the main roll and fails to cross an extension of a line normal to a contact point between the peripheral surface of the main roll and the work which is extended toward the opposite side away from the pressing member across the main roll.

In a preferred embodiment of the above-described construction, the pressing member comprises a pair of subsidiary rolls rotatably supported on the frame with their respective axes extending parallel with the axial direction of the main roll; and the second driving source is configured to selectively transmit forward rotation and backward rotation to the pair of subsidiary rolls. In this case, the moving mechanism is configured to move the pair of subsidiary rolls into a forming position in which the pair of subsidiary rolls are positioned close to the main roll to such an extent that the radius of curvature of the work which is determined from a position of a contact point between the main roll and the work and positions of contact points between the pair of subsidiary rolls and the work becomes smaller than the predetermined radius or into a retracted position in which the peripheral surface of the main roll and a peripheral surface of each of the subsidiary rolls define therebetween a spacing that is larger than the thickness of the work in a direction perpendicular to a line linking the respective axes of the pair of subsidiary rolls, selectively. The control section is configured to perform the forwardly rotating step in which the main roll is rotated forwardly with the pair of subsidiary rolls in the forming position during the move of the contact position between the peripheral surface of the main roll and the work from the first end of the work to the central portion of the work, the feeding step in which the main roll is rotated forwardly with the pair of subsidiary rolls in the retracted position during the move of the contact position between the peripheral surface of the main roll and the work from the central position of the work to the second end of the work, and the reversely rotating step in which the main roll is rotated reversely with the pair of subsidiary rolls in the forming position during the move of the contact position between the peripheral surface of the main roll and the work from the second end of the work to the central portion of the work, while rotating the pair of subsidiary rolls in a direction opposite to the direction of rotation of the main roll in each of the steps.

With this arrangement, the forwardly rotating step bends the portion of the work extending from the first end to the central portion into an arcuate shape having the radius of curvature which is determined from the position of the contact point between the main roll and the work and the positions of the contact points between the pair of subsidiary rolls and the work by passing that portion of the work between the main roll and the pair of subsidiary rolls. The reversely rotating step bends the portion of the work extending from the central portion to the second end into an arcuate shape having the radius of curvature which is determined from the position of the contact point between the main roll and the work and the positions of the contact points between the pair of subsidiary rolls and the work by passing that portion of the work between the main roll and the pair of subsidiary rolls.

As the work passes between the main roll and the pair of subsidiary rolls, a deformation toward restoration, called "spring back", occurs due to the counterforce produced by bending, resulting in a bend having an increased radius of curvature. Since the main roll has a smaller radius than the predetermined radius of the tubular shape to be formed from the work, the radius of curvature determined from the position of the contact point between the main roll and the work and the positions of the contact points between the pair of subsidiary rolls and the work is also smaller than the predetermined radius. For this reason, by adjusting the radius of the main roll and the positional relation between the main roll and the pair of subsidiary rolls for the forming process, the work having been subjected to the reversely rotating step takes on a tubular shape entirely having the predetermined radius.

The work is subjected to separate two bending steps one of which is the forwardly rotating step in which the portion of the work extending from the first end to the central portion is fed in one direction, the other of which is the reversely rotating step in which the portion of the work extending from the central portion to the second end is fed in the opposite direction. The ends of the work are displaced in directions away from the center of the radius of curvature of the resulting bend by the spring back described above. Therefore, each end of the work W fails to go beyond a 180° angle range in the circumferential direction of the main roll and fails to cross an extension of a line normal to a contact point between the peripheral surface of the main roll and the work which is extended toward the opposite side away from the pair of subsidiary rolls across the main roll.

Preferably, the arrangement described above further comprises: a support member abutting against a portion of the peripheral surface of the main roll at least plural points in the axial direction on an opposite side away from the pair of subsidiary rolls across the main roll; and a fixing member retaining the support member at least plural points in the axial direction on an opposite side away from the main roll across the support member. With this feature, even when forming a work having a continuous length in the axial direction of the main roll into a tubular shape having a small diameter, it is possible to inhibit displacement of the main roll in the direction away from the subsidiary rolls at plural points in the axial direction of the main roll, thereby to prevent an axially intermediate portion of the main roll from being deflected. Thus, the work can be formed into a tubular shape having a continuous length and a small diameter that is made uniform over the entire length.

In this case also, the work is subjected to separate two bending steps, in one of which the portion of the work extending from the first end to the central portion is fed in one direction, in the other of which the portion of the work extending from the central portion to the second end is fed in the opposite direction. Each end of the work fails to pass by the peripheral surface of the main roll on the opposite side away from the pair of subsidiary rolls across the main roll. Therefore, the support member and the fixing member, which are located on the opposite side from the pair of subsidiary rolls, fail to interfere with displacement of the first or second end of the work, thus allowing the entire work to be formed into a tubular shape. The work having subjected to the forming process defines a gap between the first end and the second end, the gap having a width that is at least equal to the width of the fixing member in the circumferential direction of the main roll. By narrowing the gap by post-processing and then welding the first end and the second end to each other, a tubular shape having a closed section can be formed.

Preferably, the tube forming apparatus further comprises a resilient member biasing the pair of subsidiary rolls toward the main roll. With this feature, the work can be reliably fed as being nipped between the main roll and the pair of subsidiary rolls in the retracted position in the feeding step following the forwardly rotating step.

Advantageous Effects of the Invention

According to the present invention, the work can be formed into a tubular shape having the predetermined radius by bending the work into an arcuate shape having a smaller radius of curvature than the predetermined radius with the spring back of the work taken into account. It is possible to prevent each end of the work from going beyond a 180° angle range in the circumferential direction of the main roll by bending circumferential halves of the work while feeding the halves in opposite directions. It is also possible to provide the member for inhibiting deformation of the main roll without interference with the work on the opposite side away from the pressing member. Thus, the work can be formed into a tubular shape having a continuous length and a small diameter that is made uniform over the entire length. Further, since the radius of the main roll is smaller enough than the predetermined radius of the tubular shape to be formed from the work, the present invention is advantageous in forming a tubular product having a continuous length and a small diameter by using a work having a high strength such as high tensile steel.

BEST MODE FOR CARRYING OUT THE INVENTION

Figure 1:
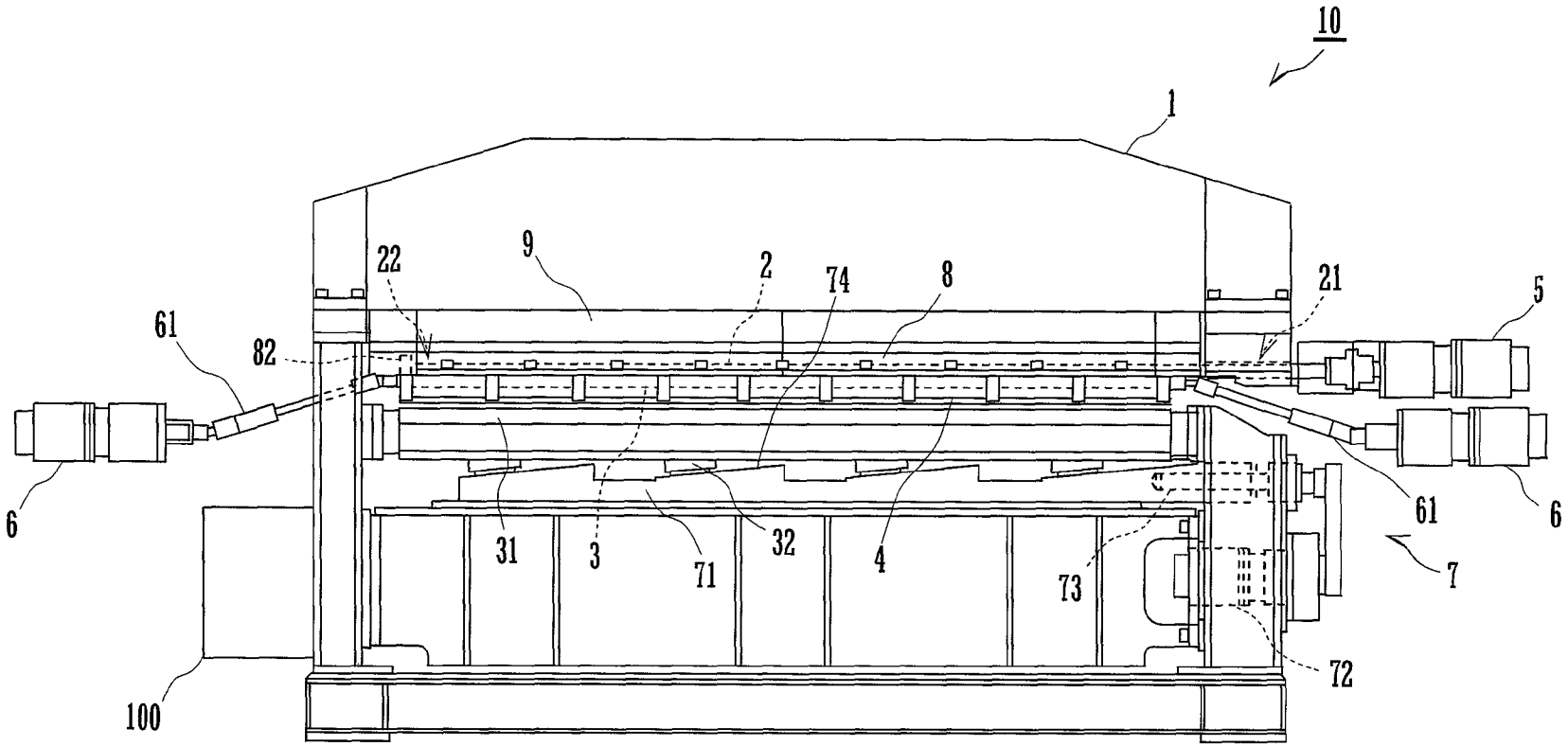
FIG. 1 is a front elevational view illustrating a tube forming apparatus according to an embodiment of the present invention.

Hereinafter, embodiments of the present invention will be described with reference to the drawings. FIG. 1 is a front elevational view illustrating a tube forming apparatus 10 according to an embodiment of the present invention.

The tube forming apparatus 10 is designed to form a work W of a plastic sheet-shaped material, such as high tensile steel for example, into a tubular shape by bending. The tube forming apparatus 10 includes a frame 1, a main roll 2, a pair of subsidiary rolls 3, pressing rolls 4, a first motor 5, second motors 6, a moving mechanism 7, a support member 8, and a fixing member 9.

The frame 1 is a rigid member shaped like a gate in a front view. The main roll 2 is rotatably supported at its first end (the right-hand side end in FIG. 1) 21 on the frame 1 and is fixed to a rotating shaft of the first motor 5. The pair of front and rear subsidiary rolls 3 are rotatably supported by a retainer 31 in such a manner that the subsidiary rolls 3 are positioned below the main roll 3 with their axes extending parallel with the main roll 3. Each of the subsidiary rolls 3 has opposite ends fixed to associated rotating shafts of the respective second motors by means of universal joints 61. The three pressing rolls 4 are arranged in the front-back direction and supported by the retainer 31 with their axes extending parallel with the pair of subsidiary rolls 3. The retainer 31 is supported on the frame 1 for vertical movement with its horizontal movement inhibited.

The first motor 5 and the second motors 6 are equivalent to respective of the "first driving source" and "second driving source" defined by the present invention. These motors each comprise a pulse motor for example and are mounted on the frame 1. The tube forming apparatus 10 has four second motors 6 in total, but may have a total of two second motors 6 which are each located at only one end of each of the two subsidiary rolls 3 or which are respectively located at opposite ends of the pair of subsidiary rolls 3.

The moving mechanism 7 is disposed below the retainer 31. The moving mechanism 7 includes a slider 71, a lifting motor 72, and a ball screw 73. The slider 71 is held on the frame 1 for sliding movement along the axial direction of the main roll 2 with its rotation inhibited. The lifting motor 72, which is a pulse motor for example, transmits rotation of its rotating shaft to the ball screw 73. The ball screw 73 threadingly engages a female thread portion formed in one lateral surface of the slider 71.

As the lifting motor 72 is rotated forwardly or backwardly, the ball screw 73 rotates to change its thread engagement position relative to the female thread portion. By changing the thread engagement position between the ball screw 73 and the female thread portion, the slider 71 is reciprocated along the axial direction of the main roll 2. The slider 71 has a top surface formed with sloped surfaces 74. Projections 32 projecting downwardly from a lower surface of the retainer 31 are each abutted against a respective one of the sloped surfaces 74. As the slider 71 reciprocates along the axial direction of the main roll 2, the retainer 31 moves up and down together with the pair of subsidiary rolls 3 and the three pressing rolls 4.

Figure 2:
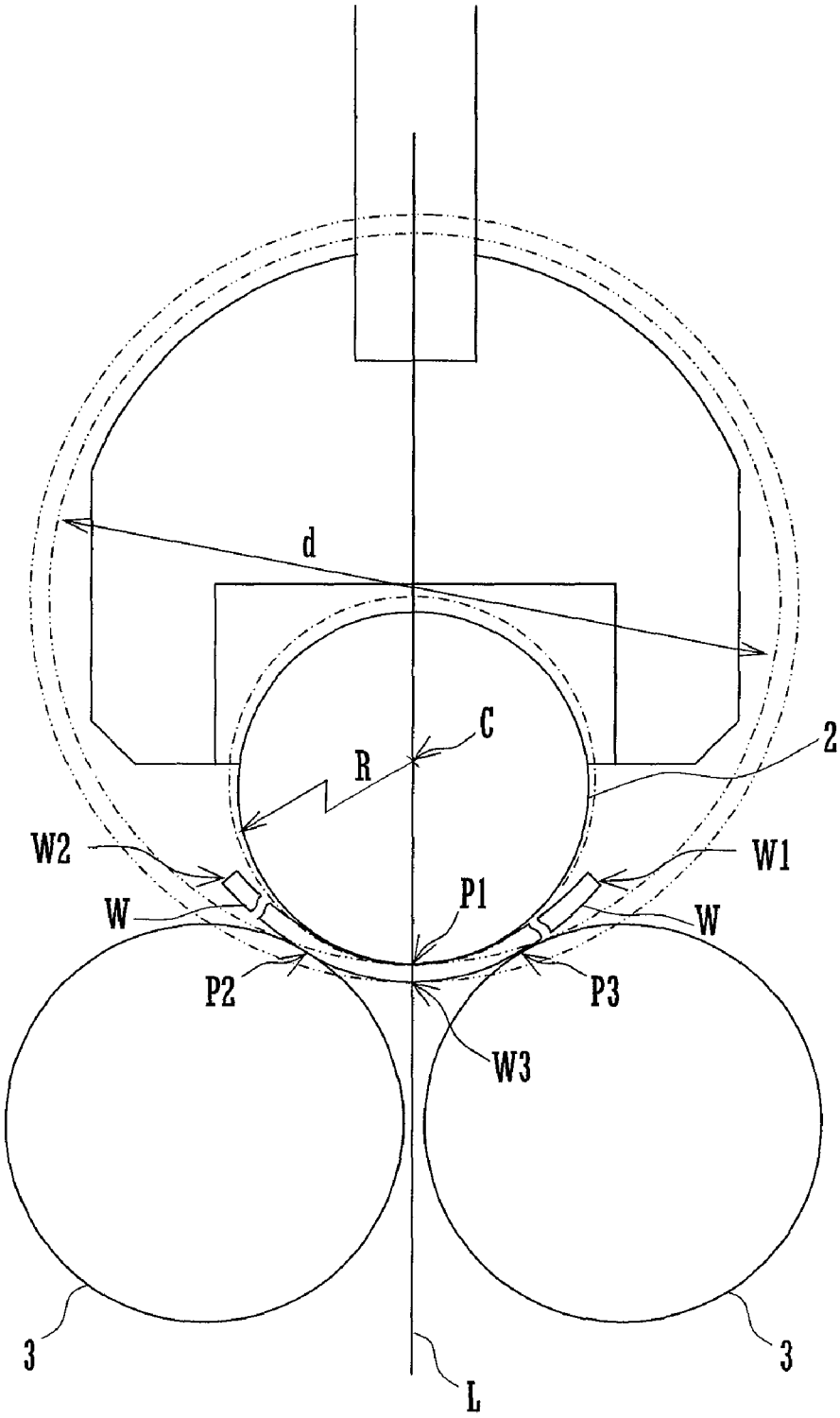
FIG. 2 is a sectional side elevational view illustrating a relevant portion of the tube forming apparatus.

FIG. 2 is a sectional side elevational view illustrating a relevant portion of the tube forming apparatus 10. The support member 8 fixed to a lower end portion of the fixing member 9 abuts against the upper side of the peripheral surface of the main roll 2 via intervening metal 81. Since the fixing member 9 is fixed to the frame 1, the fixing member 9 inhibits the main roll 2 from moving up by way of the intervening support member 8.

The support member 8 is shaped to have a smaller section than the section of the tubular shape to be formed from the work W. The main roll 2 has a radius that is smaller enough than the predetermined radius d/2 of the tubular shape to be formed from the work W.

The retainer 3, which retains the two subsidiary rolls 3 and the three pressing rolls 4 for rotation, comprises an upper member 31A and a lower member 31B. Springs 33 are disposed between the upper member 31A and the lower member 31B. The springs 33 form the "resilient member" defined by the present invention. The upper member 31A is vertically movable relative to the lower member 31B within a predetermined range, but its horizontal movement relative to the lower member 31B is inhibited by a non-illustrated pin.

As described above, as the slider 71 moves along the axial direction of the main roll 2 by rotation of the lifting motor 72, the retainer 31 moves up and down. The moving mechanism 7 moves the pair of subsidiary rolls 3 between a forming position at which the radius of curvature of the work W determined from the position of a contact point between the main roll and the work W and the positions of contact points between the pair of subsidiary rolls 3 and the work W becomes smaller enough than the predetermined radius d/2 and a retracted position at which the sheet-shaped work W passes between the main roll 2 and the pair of subsidiary rolls 3. Therefore, the pair of subsidiary rolls 3 in the retracted position are spaced more apart from the main roll 2 than in the forming position.

In lowering the pair of subsidiary rolls 3 from the forming position to the retracted position, the descending velocity of the upper member 31A is made slower than that of the lower member 31B by the resilience of the springs 33 and, hence, the pair of subsidiary rolls 3 gradually move away from the main roll 2.

In bending the work W, the pair of subsidiary rolls 3 exert a large pressing force on the main roll 2 over the entire axial length thereof. However, the main roll 2 is inhibited from being displaced upwardly over the entire axial length thereof by the fixing member 8 which abuts against the upper side of the peripheral surface of the main roll 2 by way of the intervening support member 8. For this reason, any portion of the main roll 2 that extends in the axial direction cannot be deflected upwardly by the pressing force exerted thereon by the pair of subsidiary rolls 3.

Figure 3:
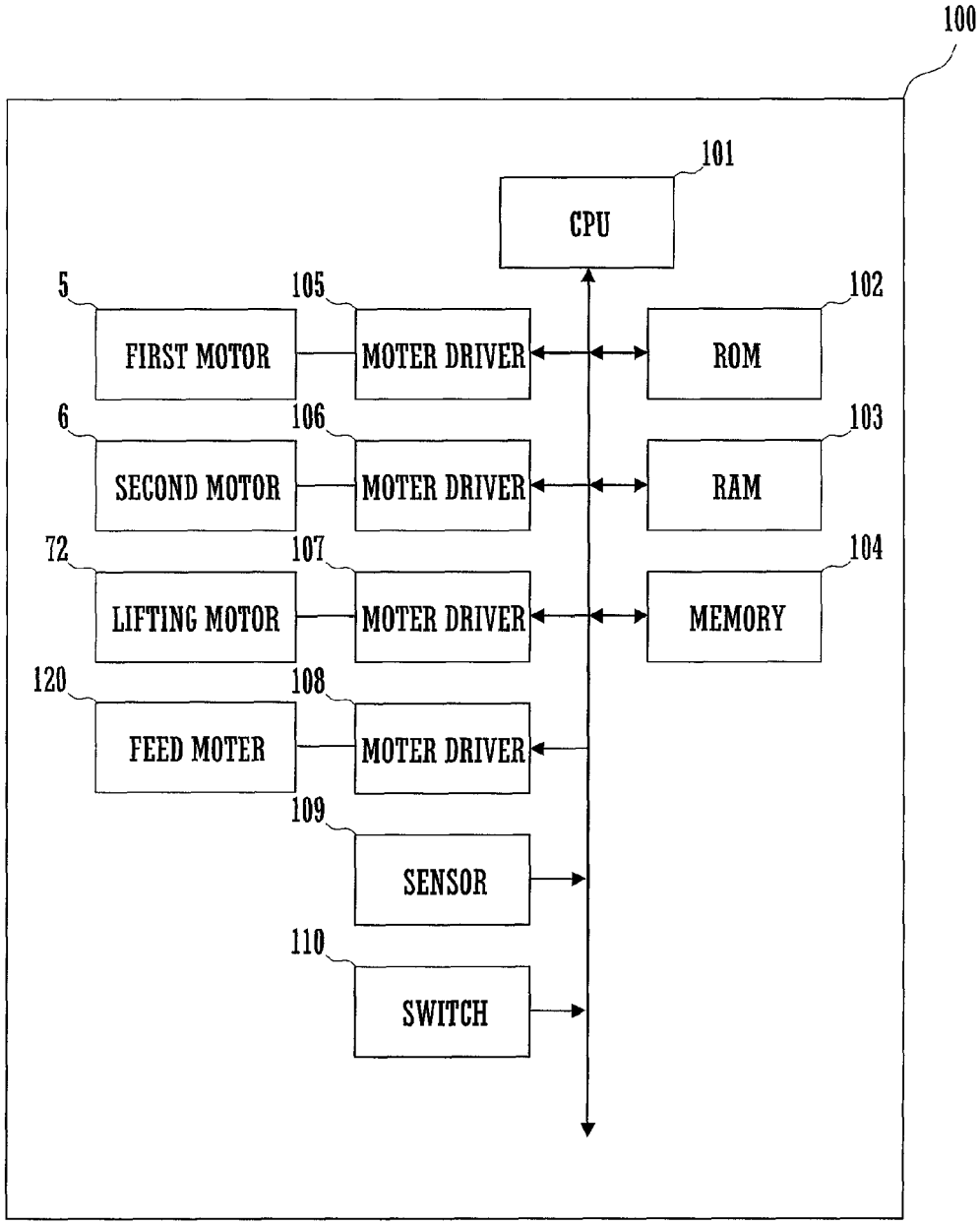
FIG. 3 is a block diagram illustrating a control section of the tube forming apparatus.

FIG. 3 is a block diagram illustrating a control section 100 of the tube forming apparatus 10. FIGS. 4(A) to 4(D) are sectional views of a relevant portion of the tube forming apparatus 10 for illustrating process steps of bending the work W. The control section 100 comprises a CPU 101 provided with ROM 102 and RAM 103, and memory 104, motor drivers 105 to 108, a switch 109 and a sensor 110 which are connected to the CPU 101.

The CPU 101 controls the motor drivers 105 to 108 and the like according to programs previously stored in the ROM 102. The RAM 103 has a predetermined memory area used as a working area. The memory 104 has rewritably and nonvolatily stored therein control data to be used for the bending process.

The motor drivers 105 to 108 are connected to the first motor 5, second motors 6, lifting motor 72 and feed motor 120, respectively. The CPU 101 references driving pulses count data stored in the memory 104 to output driving data to the motor drivers 105 to 108. The motor drivers 105 to 108 drive the first motor 5, second motors 6, lifting motor 72 and feed motor 120 based on the driving data inputted thereto from the CPU 101.

The switch 109 receives an operation for instruction to start bending the work W. The sensor 110 detects the position of the pair of subsidiary rolls 3 either directly or by way of the position of the retainer 31. For example, the sensor 110 outputs an ON signal upon detection of the pair of subsidiary rolls 3 in the retracted position.

The feed motor 110, which is a pulse motor for example, drives a mechanism for feeding the work W to between the main roll 2 and the pair of subsidiary rolls 3.

When the tube forming apparatus 10 is powered on, the CPU 101 receives a detection signal from the sensor 110 to determine whether or not the pair of subsidiary rolls 3 are in the retracted position. When the pair of subsidiary rolls 3 are not in the retracted position, the CPU 101 rotates the lifting motor 72 backwardly to lower the retainer 31 until the sensor 110 detects the pair of subsidiary rolls 3 in the retracted position.

Figures 4A, 4B, 4C, 4D:
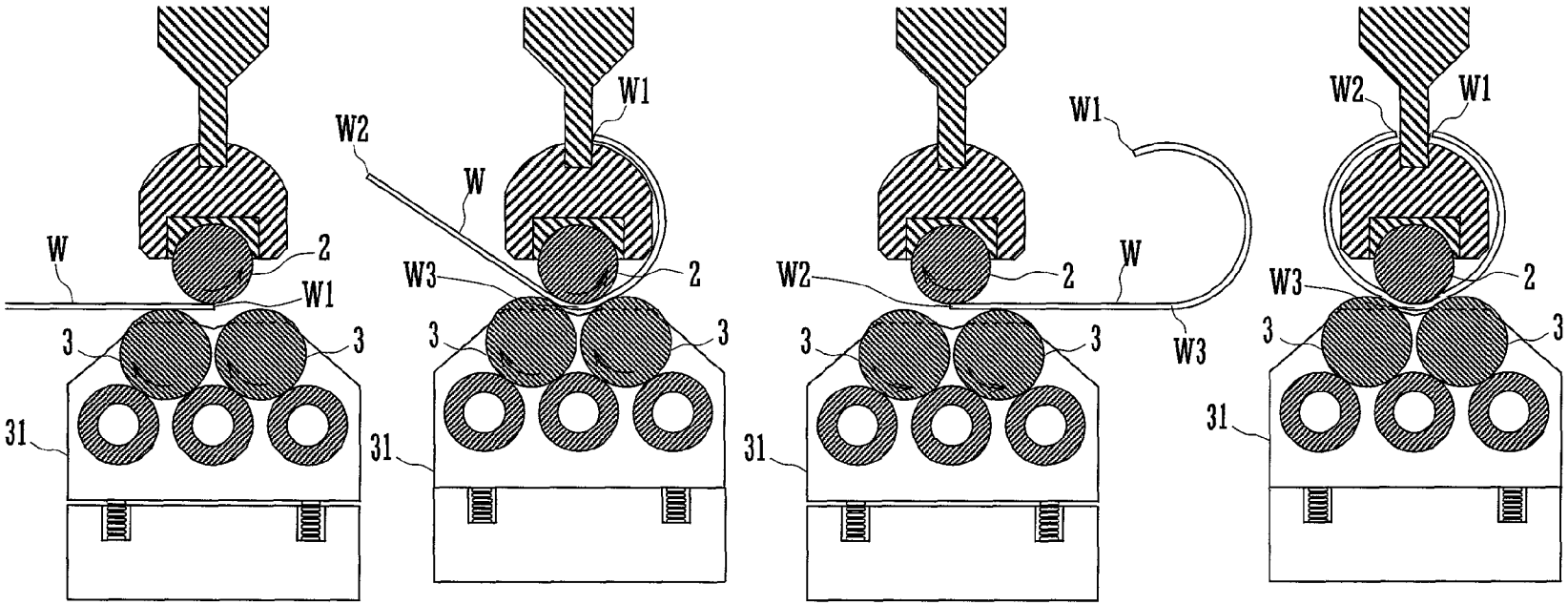
FIGS. 4A-4D are sectional views of a relevant portion of a tube forming apparatus 10 for illustrating process steps of bending a work W by the tube forming apparatus 10.

With the pair of subsidiary rolls 3 in the retracted position, the CPU 101 waits for the switch 109 to be operated. When the switch 109 is operated, the CPU 101 causes the motor driver 108 to drive the feed motor 110 by a predetermined pulses count so that the sheet-shaped work W is horizontally fed to between the main roll 2 and the pair of subsidiary rolls 3 until its first end W1 is brought into contact with the main roll 2 as shown in FIG. 4A.

Subsequently, the CPU 101 drives the lifting motor 72 by a predetermined pulses count to lift the retainer 31 until the pair of subsidiary rolls 3 assume the forming position. When the pair of subsidiary rolls 3 reach the forming position, the CPU 101 performs a forwardly rotating step as shown in FIG. 4B by rotating the first motor 5 forwardly to cause the main roll 2 to rotate counterclockwise in FIGS. 4A-4D while rotating the second motors 6 backwardly to cause the pair of subsidiary rolls 3 to rotate clockwise in FIGS. 4A-4D. By so doing, the work W is bent along the peripheral surface of the main roll 2 while moving toward the right-hand side of FIGS. 4A-4D.

The radius of the main roll 2 is smaller enough than the predetermined radius d/2. The radius of curvature of the work W obtained by bending, which is determined from the position of a contact point between the main roll 2 and the work W and the positions of contact points between the pair of subsidiary rolls 3 and the work W, is also smaller enough than the predetermined radius d/2. However, bending stress is produced in the work W during bending. The bending stress causes the spring back, which is deformation in the direction opposite to the bending direction, to occur after the work W has passed between the main roll 2 and the right-hand side subsidiary roll 3. The radius of curvature of the work W which is obtained after the spring back has occurred is determined from the radius of curvature determined from the position of the contact point between the main roll 2 and the work W and the positions of the contact points between the pair of subsidiary rolls 3 and the work W and the strength of the work W.

Therefore, by appropriately setting the forming position of the pair of subsidiary rolls 3 based on the material and thickness of the work W and the predetermined radius of the work W which is required after forming, the radius of curvature of the work W which is obtained after the occurrence of the spring back can be made equal to the predetermined radius of the work W which is required after forming.

When a central portion W3 of the work W comes into contact with the peripheral surface of the main roll 2 as the work W moves toward the right-hand side of FIGS. 4A-4D while bending, the CPU 101 performs a feeding step by rotating the lifting motor 72 backwardly by a predetermined pulses count to lower the pair of subsidiary rolls 3 into the retracted position. The time to start the feeding step is determined from, for example, the driving pulses count of the first motor 5 from the start of the forward rotation of the first motor 5 and the backward rotation of the second motors 6. By the feeding step the work W moves toward the right-hand side of FIGS. 4A-4D with its left-hand side portion from the central portion W3 being kept flat.

Since the pair of subsidiary rolls 3 are lowered gradually by the resilience of the springs 33, the work W can be reliably moved toward the right-hand side of FIGS. 4A-4D even when the work W is in intimate contact with the peripheral surface of the main roll 2. Other resilient member, such as a damper, may be used instead of the springs 33. In cases where the work W is unlikely to come into intimate contact with the main roll 2, the resilient member may be eliminated.

As shown in FIG. 4C, when a second end W2 of the work W reaches a position for contact with the peripheral surface of the main roll 2, the CPU 101 temporarily stops the forward rotation of the first motor 5 and the backward rotation of the second motors 6 and then forwardly rotates the lifting motor 72 to lift the pair of subsidiary rolls 3 into the forming position. The time to stop the rotations of the main roll 5 and the subsidiary rolls 6 is determined from, for example, the driving pulses count of the first motor 5 from the start of the forward rotation of the first motor 5 and the backward rotation of the second motors 6. When the pair of subsidiary rolls 6 assume the forming position again, the CPU 101 performs a reversely rotating step by rotating the first motor 5 backwardly to cause the main roll 2 to rotate clockwise in FIGS. 4A-4D while rotating the second motors 6 forwardly to cause the pair of subsidiary rolls 3 to rotate counterclockwise in FIGS. 4A-4D. The reversely rotating step causes the work W to move toward the left-hand side of FIGS. 4A-4D while bending its right-hand side portion from the second end W2 along the peripheral surface of the main roll 2.

As shown in FIG. 4D, when the central portion W3 of the work W reaches the position for contact with the main roll 2 again, the CPU 101 stops the backward rotation of the first motor 5 and the forward rotation of the second motors 6 and rotates the lifting motor 72 backwardly to lower the pair of subsidiary rolls 3 into the retracted position. The time to perform this step is determined from, for example, the driving pulses count of the first motor 5 from the start of the backward rotation of the first motor 5 and the forward rotation of the second motors 6.

By so doing, the portion of the work W which extends from the second end W2 to the central portion W3 is also bent to have the same radius of curvature as the other portion of the work W which extends from the first end W1 to the central portion W3. In this way, the work W is formed into a tubular shape.

Figure 5:
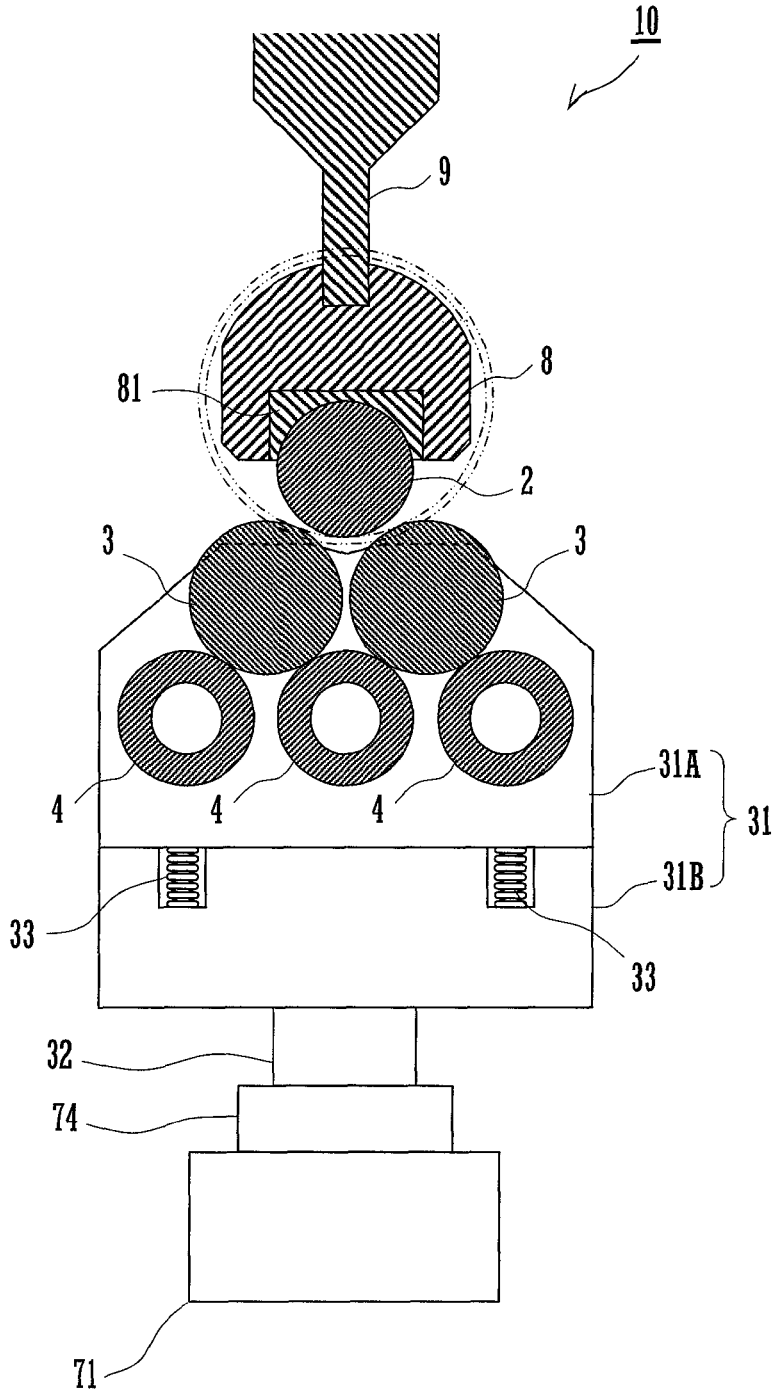
FIG. 5 is a view illustrating a deformed state of the work W bent by the tube forming apparatus 10.

FIG. 5 is a view illustrating a deformed state of the work W bent by the tube forming apparatus 10. As described above, the work W is halved in the feeding direction to have the portion extending from the first end W1 to the central portion W3 and the portion extending from the central portion W3 to the second end W2. The former and latter portions are bent by the forwardly rotating step and the reversely rotating step, respectively. In the forwardly rotating step, the portion of the work W which extends from the first end W1 to the central portion W3 is bent into an arcuate shape having a radius of curvature R which is determined from the position of a contact point P1 between the work W and the main roll 2 and the positions of contact points P2 and P3 between the work W and the pair of subsidiary rolls 3 by the passage thereof between the main roll 2 and the pair of subsidiary rolls 3. In the reversely rotating step, the portion of the work W which extends from the central portion W3 to the second end W2 is bent into an arcuate shape having the radius of curvature R determined from the position of the contact point P1 between the work W and the main roll 2 and the positions of the contact points P2 and P3 between the work W and the pair of subsidiary rolls 3 by the passage thereof between the main roll 2 and the pair of subsidiary rolls 3.

As the work W passes between the main roll 2 and the pair of subsidiary rolls 3, the radius of curvature of the resulting bend is increased by the spring back due to the counterforce produced by bending. The radius of the main roll 2 is smaller enough than the predetermined radius d/2 of the tubular shape to be formed from the work W. The radius of curvature R determined from the positions of the contact points P1 to P3 is also smaller enough than the predetermined radius d/2. Therefore, by appropriately adjusting the radius of the main roll 2 and the positional relation between the main roll 2 and the pair of subsidiary rolls 3 for the forming process with the spring back of the work W taken into account, the work W can be formed into the tubular shape entirely having the predetermined radius d/2 after the reversely rotating step.

The work W is halved into the portion extending from the first end W1 to the central portion W3 and the portion extending from the central portion W3 to the second end W2. These portions are bent into semicircular shapes by the respective steps, i.e., the forwardly rotating step and the reversely rotating step. The first end W1 and the second end W2 are displaced away from the center C of the radius of curvature of the resulting bend in the forwardly rotating step and the reversely rotating step, respectively. Therefore, each end of the work W fails to go beyond a 180° angle range in the circumferential direction of the main roll 2, while the first end W1 and the second end W2 fail to cross an extension of a line L normal to the contact point P1 which is extended toward the opposite side away from the pair of subsidiary rolls 3 across the main roll 2.

For this reason, a space for placing the fixing member 9 which prevents the main roll 2 from being deflected away from the pair of subsidiary rolls 3 can be provided adjacent the circumference of the main roll 2 on the opposite side away from the pair of subsidiary rolls 3. Therefore, the work W comprising, for example, a material having a high strength such as high tensile steel can be formed into a tubular shape having a continuous length and a small diameter that is made uniform over the entire length.

The work W thus shaped tubular which results from the forming process carried out by the tube forming apparatus 10 defines a gap between the first end W1 and the second end W2, the gap having a width that is at least equal to the width of the fixing member 8. When the width of the gap is relatively large, a single pipe roll manufacturing apparatus having plural pairs of upper and lower rolls arranged side by side is provided downstream of the tube forming apparatus 10 and is used to narrow the gap while making the tubular work W have a higher roundness and then weld the gap portion to form a tubular shape having a closed section.

The pair of subsidiary rolls may be replaced with a single pressing member. Such a pressing member may comprise, for example, an elastic member such as a urethane roll. Such an elastic member need not necessarily be in the form of roll, but may have a flat surface which is capable of reciprocating in the direction perpendicular to the axial direction of the main roll. The pressing member in the forming position deforms elastically to form a cavity having a radius of curvature substantially equal to that of the main roll in the surface when abutted against the main roll across the work.

The foregoing embodiments are illustrative in all points and should not be construed to limit the present invention. The scope of the present invention is defined not by the foregoing embodiments but by the following claims. Further, the scope of the present invention is intended to include all modifications within the scopes of the claims and within the meanings and scopes of equivalents.

DESCRIPTION OF REFERENCE CHARACTERS

1 frame
2 main roll
3 subsidiary roll
4 pressing roll
5 first motor (first driving source)
6 second motor (second driving source)
7 moving mechanism
8 support member
9 fixing member
10 tube forming apparatus

The invention claimed is:

1. A tube forming apparatus for forming a work of a plastic sheet-shaped material into a tubular shape having a predetermined radius by bending, the tube forming apparatus comprising:

a frame;

a main roll rotatably supported on the frame and having a smaller radius than the predetermined radius;

a pair of subsidiary rolls disposed such that a surface thereof and a peripheral surface of the main roll are capable of nipping the work therebetween and rotatably supported on the frame with their respective axes extending parallel with an axial direction of the main roll;

a first driving source configured to selectively transmit forward rotation and backward rotation to the main roll;

a second driving source configured to selectively transmit forward rotation and backward rotation to the pair of subsidiary rolls;

a moving mechanism configured to move the pair of subsidiary rolls into a forming position in which the pair of subsidiary rolls are positioned close to the main roll to such an extent that the radius of curvature of the work which is determined from a position of a contact point between the main roll and the work and positions of contact points between the pair of subsidiary rolls and the work becomes smaller than the predetermined radius or into a retracted position in which the peripheral surface of the main roll and a peripheral surface of each of the subsidiary rolls define therebetween a spacing that is larger than the thickness of the work in a direction perpendicular to a line linking the respective axes of the pair of subsidiary rolls, selectively;

a support member rotatably supporting the main roll at at least plural points in the axial direction on an opposite side away from the pair of subsidiary rolls across the main roll, the support member being shaped to have a smaller section than a predetermined radius of a circle having a position in which the main roll and the work contact on the opposite side of the pair of subsidiary rolls as a lower end position, and a bigger section than the main roll, the opposite side away from the pair of subsidiary rolls across the main roll having an arcuate shape;

a fixing member fixed to the frame and retaining the support member at at least plural points in the axial direction on an opposite side away from the main roll across the support member; and a control section configured to control the first and second driving sources and the moving mechanism, wherein during the bending, the control section sequentially performs a forwardly rotating step of forwardly rotating the main roll during a move of a contact position between the peripheral surface of the main roll with the pair of subsidiary rolls positioned in the forming position and the work from a first end of the work to a central portion of the work, a feeding step of forwardly rotating the main roll during a move of a contact position between the peripheral surface of the main roll with the pair of subsidiary rolls positioned in the retracted position and the work from the central position of the work to a second end of the work, and a reversely rotating step of reversely rotating the main roll during a move of the contact position between the peripheral surface of the main roll with the pair of subsidiary rolls positioned in the forming position and the work from the second end of the work to the central portion of the work, while rotating the pair of subsidiary rolls in a direction opposite to the direction of rotation of the main roll in each of the steps.

2. The tube forming apparatus according to claim 1, further comprising a resilient member biasing the pair of subsidiary roll toward the main roll.

* * * * *